US005230237A

United States Patent [19]

Johansson

[11] Patent Number: 5,230,237

[45] Date of Patent: Jul. 27, 1993

[54] CUTTING AND FLANGING TOOLS

[76] Inventor: Bo E. Johansson, 20 Farraxton Square, Northhampton NN4 9EQ, England

[21] Appl. No.: 880,024

[22] Filed: May 8, 1992

[51] Int. Cl.[5] ..... B21D 28/02

[52] U.S. Cl. ..... 72/335; 72/464; 72/454

[58] Field of Search ..... 72/335, 327, 333, 477, 72/464, 454, 453.15, 453.12; 29/243, 519

[56] References Cited

U.S. PATENT DOCUMENTS

| | | | |
|---|---|---|---|
| 1,342,263 | 6/1920 | Goben | 72/454 |
| 2,069,231 | 2/1937 | Findlay | 72/464 |
| 2,348,875 | 5/1944 | Beard | 72/335 |
| 3,494,168 | 2/1970 | Williamson | 72/335 |
| 3,878,950 | 4/1975 | Quinn | 72/335 |
| 4,761,987 | 8/1988 | Gamauf | 72/454 |

FOREIGN PATENT DOCUMENTS

| | | | |
|---|---|---|---|
| 269941 | 11/1986 | Japan | 72/335 |
| 153478 | 1/1963 | U.S.S.R. | 72/454 |
| 1038003 | 8/1983 | U.S.S.R. | 72/327 |
| 1176998 | 9/1985 | U.S.S.R. | 72/335 |

*Primary Examiner*—Daniel C. Crane

*Attorney, Agent, or Firm*—Oblon, Spivak, McClelland, Maier & Neustadt

[57] ABSTRACT

A combined punch and flange forming tool comprises a double-ended female die 7 and a punch 4. Initially, a first portion 2 of the female die is used in association with a cylindrical portion 8 of the punch to cut the required hole in the work-piece 11. Thereafter, the female die is reversed and flange forming profiles 17,18 on the punch and female die respectively are used to deform the work-piece to provide the desired flange surrounding the hole.

3 Claims, 2 Drawing Sheets

CUTTING AND FLANGING TOOLS

Figure 1:
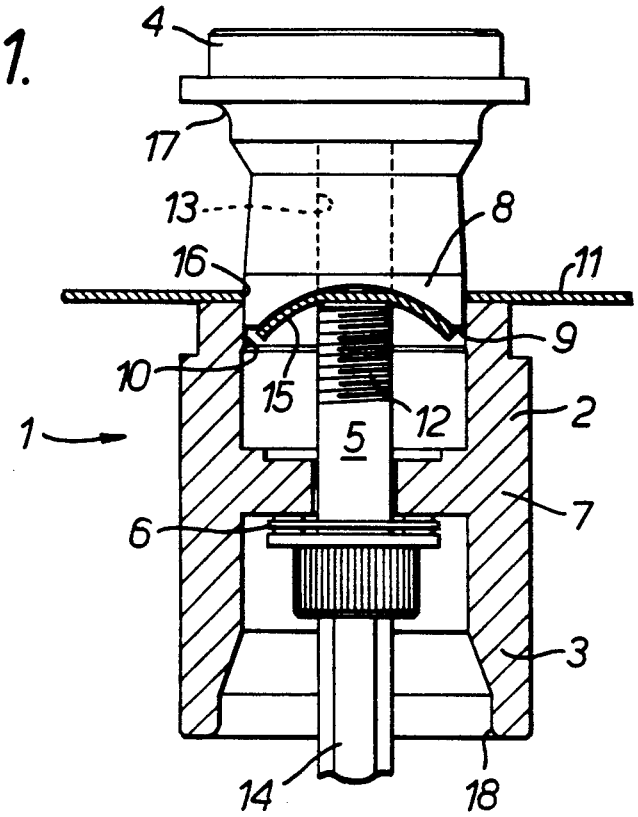

The present invention relates to cutting and flanging tools. More particularly, but not exclusively, it relates to a tool which may be operated by hand to produce a hole, and then to produce a flange around the hole.

It is known in aircraft construction and in motor car production, especially the construction of high performance motor cars, to reduce the weight of the structure by forming lightening holes in some structural members. In order to preserve the rigidity of the structure, it is preferable to produce a flange around the holes. Tools for producing holes by hand operation are known from British patents 619178 and 938098. These may be used by an operator with comparative ease to produce a hole by hand, However, once the hole is produced, production of a flange surrounding the hole is generally carried out, fairly laboriously, by manual means.

It is an object of the present invention to provide a tool able to produce a flange around a hole with comparative ease, and by hand.

According to a first aspect of the present invention there is provided a tool comprising: a first female die member adapted to be located on one side of a work piece; a male punch member adapted to be located on an opposite side of said work piece; means for forcing the leading end of the punch into the first female die to cut a hole in the work-piece; a second female die member adapted to be located surrounding the leading end of the punch in place of the first female die member; and means for forcing the punch further into the second female die member whereby cooperating surfaces of the punch and the second female die member will deform the work piece to produce a flange surrounding the hole.

Preferably, the means for forcing the leading end of the punch into the first female die member to punch a hole in the work-piece comprises means adapted to pass through a pilot hole provided in the work-piece to interconnect the punch and the first female die and apply a force to the punch drawing it into the first female die. Such means may comprise a hydraulic actuator, but in the preferred embodiment comprises a bolt or screw which engages a screw-threaded hole provided in the punch and reacts against a reaction surface provided on the die. Preferably, a ball or roller thrust bearing is interposed between the head of the screw or bolt and the reaction surface provided on the first female die member in order to reduce the torque required to form the hole.

Preferably, the means for forcing the punch further into the second female die is constituted by the same device as that used to force the leading end of the punch into the first female die to form the hole in the work-piece.

Preferably, the first female die member and the second female die member are a conjoined back-to-back to produce a female die one end of which constitutes the first female die member and the opposite end of which constitutes the second female die member. In this case, after the hole in the work-piece has been cut using the punch and first female die member the means for forcing the leading end of the punch into the first female die member is released, the female die is reversed to locate the second female die member surrounding the leading end of the punch, and the means for forcing the punch into the die member is replaced so as to force the punch further into the second female die member and effect the required deformation of the work-piece.

By appropriate design of the punch and the second female die member a wide range of flange profiles can be obtained.

Figure 2:
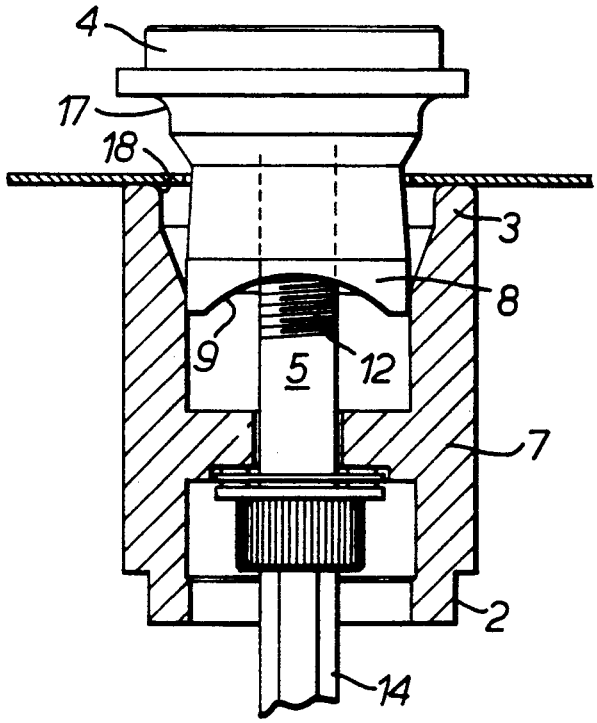
Figure 3:
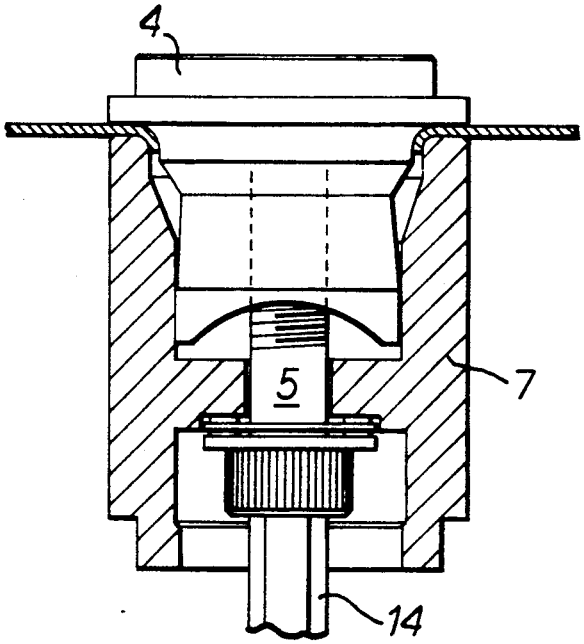

The invention will be better understood from the following description of a preferred embodiment thereof, given by way of example only, reference being had to the accompanying drawings wherein:

FIGS. 1–3 illustrate progressive steps in the use of an embodiment of the invention to form a flanged hole in a work piece.

FIG. Referring firstly to FIG. 1, the illustrated tool 1 comprises a first female die member 2, a second female die member 3, a male punch member 4, a bolt 5 and a roller thrust bearing 6.

The first and second female die members are arranged back-to-back and form the opposite ends of a double-ended female die 7. The lower portion 8 of the punch 4 is substantially cylindrical and terminates in a cutting edge 9. The upper part 10 of the first female die member is substantially cylindrical and is sized to receive the lower portion 8 of the punch 4 with a small working clearance.

In use, a clearance hole for the bolt 5 is formed in the work-piece 11 and the bolt, assembled with the female die, is offered up to one side of the work-piece so that the threaded portion 12 of the bolt passes through the pilot hole. The punch 4 includes a screw-threaded bore 13 for screw-threaded engagement with the screw-threads 12 of the bolt, and after the bolt and female die have been positioned as described above the punch 4 is screwed onto the protruding bolt until the cutting surface 9 abuts the surface of the work-piece. A suitable tool 14 is then used to rotate the bolt 5 to force the leading end 8 of the punch into the first female die member 2 and thereby remove a disc 15 from the work-piece to form a clean hole 16.

At this stage, rotation of the tool 14 is reversed to unscrew the bolt 12 from the threaded bore 13 of the punch 4, and the female member 7 is removed. The bolt 5 is then reversed in the female die and the female die and bolt are again offered up to the punch and the screw-threads 12 of the bolt are engaged in the threaded aperture 13. This configuration is illustrated in FIG. 2. It will be noted that the second female die member 3 is now presented to the work-piece.

The tool 14 is again rotated to force the punch 4 further into the second female die member to deform the portions of the work-piece surrounding the hole 16. To this end, the punch 4 is formed with a flange forming profile 17 and a complementary flange forming profile 18 is formed on the second female die member. As the bolt 5 is rotated the flange forming surfaces 17,18 deform the material of the work-piece to produce the required flange 19. Rotation of the tool 14 may then be reversed to remove the bolt from the punch 4, whereupon the punch may be withdrawn from the hole leaving a neat and symmetrical flanged hole in the work-piece.

By appropriately shaping the flange forming surfaces of the punch and the second female member a wide range of possible flange profiles may be provided.

If desired, the female die and/or punch may be furnished with flats to facilitate gripping of the part in a vice.

The provision of the thrust roller bearing 6 substantially reduces the torque required to operate the device, as compared with the torque which would be required if a simple friction bearing was provided between the head 20 of the bolt 6 and the cooperating thrust surface of the female die.

Although the use of a threaded bolt and cooperating screw-thread provides a simple and effective means of operating the device of the invention the invention may be operated utilizing other means of providing an appropriate force—for example by means of a hydraulically powered actuator.

I claim:

1. A cutting and flanging tool comprising: a male punch member having a cutting edge at the leading end thereof and a deformation surface located spaced rearwardly of the cutting edge; a double ended female die member having first and second ends, the first end of said female die member cooperating with the cutting edge of the male punch member to cut a hole in a workpiece by removing a disc of material therefrom, and the second end of said female die member being formed with a deformation surface to cooperate with the deformation surface of the male punch member to deform portions of the workpiece located therebetween; and force applying means for passing through a pilot hole provided in a workpiece and interconnecting the male punch member and the female die member, with the first end of the female die member presented to the workpiece, to apply a force to the male punch member and the female die member to draw the male punch member into the first end of said female die member to cut a hole into the workpiece by removing a disc of material therefrom; means for releasing said force applying means after said hole has been cut to permit reversal of the female die member, and means for thereafter interconnecting the male punch member and the female die member, with the second end of the female die member presented to the workpiece, to apply force to the male punch member and the female die member to draw the male punch member into the second end of the female die member to clamp the material of the workpiece between the respective deformation surfaces of the male punch member and the female die member to deform the material of the workpiece surrounding the hole into a flange of controlled shape.

2. A tool according to claim 1 wherein the means for drawing the punch member into the first and second ends of the female die member comprises a screw which engages a screw-threaded hole provided in the punch member and reacts against reaction surfaces on the die member.

3. A tool according to claim 2 wherein a ball or roller thrust bearing is interposed between a head of the screw and the reaction surfaces provided on the female die member in order to reduce the torque required to form the hole.

* * * * *